US005533926A

United States Patent [19]

Nemazi

[11] Patent Number: 5,533,926

[45] **Date of Patent: *Jul. 9, 1996**

[54] SANDPAPER PAD AND PAD SUPPORT FOR A DETAIL SANDER

[75] Inventor: John E. Nemazi, Bloomfield Hills, Mich.

[73] Assignee: Ryobi North America, Easley, S.C.

[ * ] Notice: The term of this patent shall not extend beyond the expiration date of Pat. No. 5,437,571.

[21] Appl. No.: 384,149

[22] Filed: Feb. 6, 1995

Related U.S. Application Data

[63] Continuation-in-part of Ser. No. 240,386, May 10, 1994, Pat. No. 5,437,571, which is a continuation of Ser. No. 940,979, Sep. 4, 1992, and a continuation of Ser. No. 7,338, Apr. 20, 1993, Pat. No. Des. 355,105.

[51] Int. Cl.[6] ..... B24D 17/00

[52] U.S. Cl. ..... 451/490; 451/356; 451/344

[58] Field of Search ..... 451/162, 163, 451/164, 344, 351, 356, 357, 359

[56] References Cited

U.S. PATENT DOCUMENTS

| | | | |
|---|---|---|---|
| D. 343,104 | 1/1994 | Hoshino . | |
| 2,350,098 | 5/1944 | Decker . | |
| 3,160,995 | 12/1964 | Danuski, Jr. . | |
| 3,190,045 | 6/1965 | Zuzelo . | |
| 4,640,060 | 2/1987 | Lukianoff . | |
| 4,825,597 | 5/1989 | Matechuk . | |
| 4,905,420 | 3/1990 | Flachenecker et al. . | |
| 4,920,702 | 5/1990 | Kloss et al. . | |
| 5,123,216 | 6/1992 | Kloss et al. . | |
| 5,319,889 | 6/1994 | Rudolf et al. . | |
| 5,398,457 | 3/1995 | Undegrave et al. | 451/356 |
| 5,437,571 | 8/1995 | Everts et al. | 451/344 |

FOREIGN PATENT DOCUMENTS

| | | |
|---|---|---|
| 737766 | 5/1986 | France . |
| 3540561 | 11/1985 | Germany . |
| 3706906A1 | 9/1988 | Germany . |
| 3840974A1 | 6/1990 | Germany . |
| 4115862 | 4/1992 | Japan . |

OTHER PUBLICATIONS

Fein Sander Product Manual, Mar., 1990, entire document.
Undated Drawings of Ali Industries, Inc. Sandpaper Pad.

*Primary Examiner*—Bruce M. Kisliuk
*Assistant Examiner*—G. Nguyen
*Attorney, Agent, or Firm*—Brooks & Kushman

[57] ABSTRACT

A sandpaper pad and a pad support of corresponding shape is provided for use with a detail sander. The sandpaper pad and pad support each has a substantially 90° forward corner formed by a pair of facet edges. A pair of outwardly inclined straight side edges extend rearwardly from the facet edges on opposite sides of the pad center line each being outwardly inclined from the center line 10°–30°. When the straight side edges are in use, the forward corner is inwardly offset, thereby minimizing forward corner wear.

10 Claims, 6 Drawing Sheets

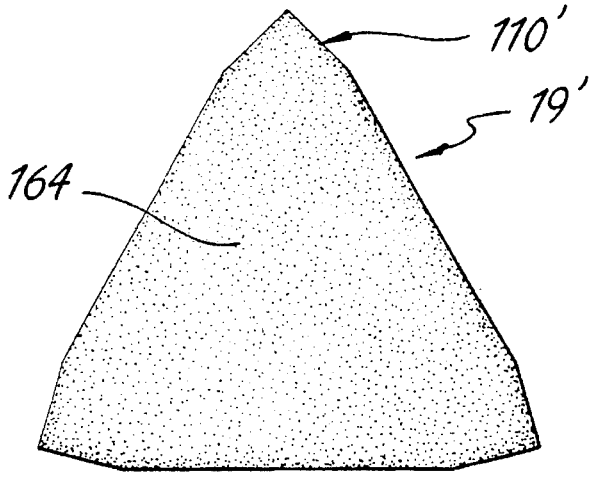
Fig-14
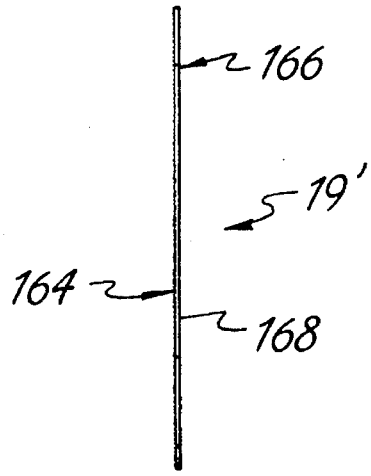
Fig-15
Fig-16
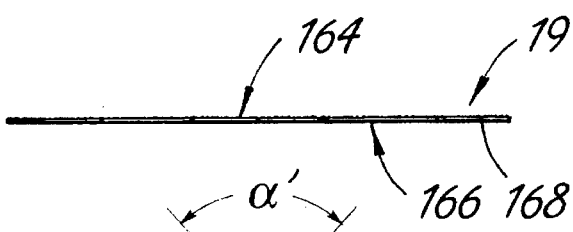
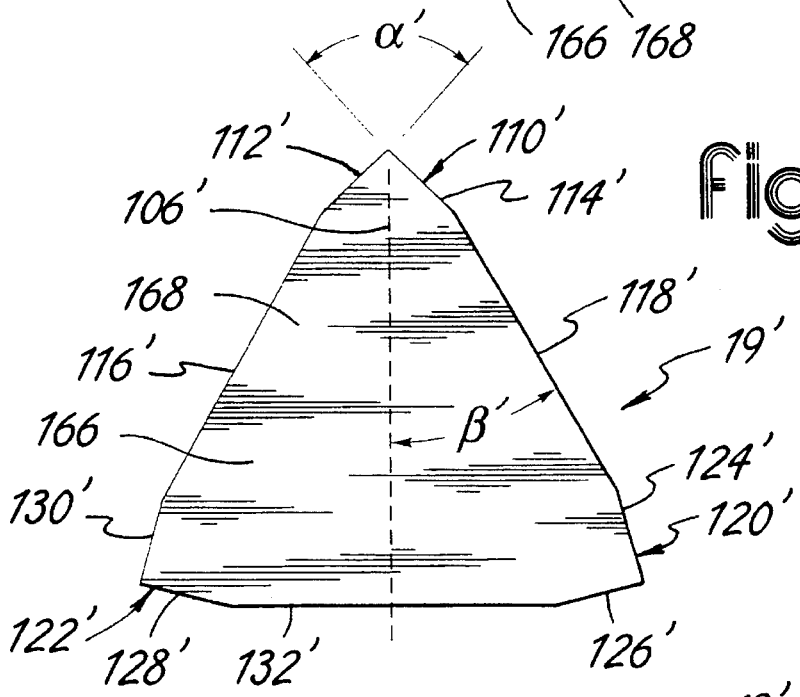
Fig-17
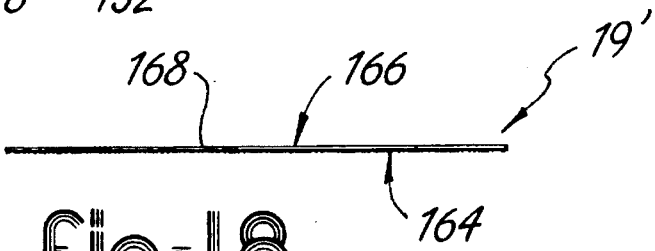
Fig-18

SANDPAPER PAD AND PAD SUPPORT FOR A DETAIL SANDER

This application is a continuation-in-part of two earlier commonly owned patent applications, the first being utility patent application Ser. No. 240,386, filed May 10, 1994 entitled "Detail Sander" which is now issued as U.S. Pat. No. 5,437,571 which is a continuation of Ser. No. 940,979, filed Sep. 4, 1992; the second is design patent application Ser. No. 007,338, filed Apr. 20, 1993, entitled "Adhesive Pad", which is now issued as U.S. Pat. No. 355,105.

TECHNICAL FIELD

This invention relates to an oscillating tool and more particularly to a mechanism for oscillatingly driving a sanding tool about a remotely located pivot axis.

BACKGROUND ART

Detail sanders are used for performing specific finishing tasks such as sanding edges adjacent internal walls. To perform such tasks, the tools utilized must be able to have controlled finite movement in a confined area so as to fine sand the desired area without damaging the surface upon which the work is being performed. Various approaches have been taken to perform the difficult task of sanding these internal corners and other hard to reach areas which require fine sanding or abrasion.

Initially, hand sanders were utilized to perform these tasks. U.S. Pat. No. 4,825,597 to Matechuk discloses a corner hand sander which has a sanding surface in the form of a prism having an angle of 90 degrees. Electrically operated tools replaced hand corner sanders similar to the one disclosed above. A common feature among the electrically driven sanders or grinders is that all utilize pivotal or oscillating motion or rotational motion to drive the abrasive pad.

U.S. Pat. No. 4,920,702 to Kloss et al., discloses a portable grinder relying upon pivotal motion by oscillating about a fixed axis which intersects the grinding tool in a central region. The abrasive pad has exposed side edges which are convex in shape such that side edges meet to form at least one corner region having an angle of less than 90 degrees. A similar pear-shaped oscillating abrasive pad for reaching into square corners is described in UK patent 2141620 to Brown.

U.S. Pat. No. 3,190,045 to Zuzelo, discloses an abrasive tool defining an equilateral triangle having three convex sides such that each side is curved in the form of an arc centered on the opposing vertex. The tool rotates about a central axis and has 3 corners which form approximately 90° angles for grinding or polishing into square corners.

An alternative approach is disclosed in U.S. Pat. No. 3,160,995 to Damuski, Jr. in which a corner sander has an oscillating or reciprocating sector-shaped abrasive pad. The pad contains a pair of radiant side edges which move through a total angle just slightly less than the 90 degree angle of the corner to be finished.

U.S. Pat. No. 2,350,098 to Decker discloses an oscillating sander which has a sanding head which has an abrasive pad which is driven about an angle transverse to and at a right angle with the motor drive shaft.

U.S. Pat. No. 2,734,139 to Murphy discloses an electrically operated eraser which utilizes spaced magnetic poles and an adjacent armature movable therebetween for actuating the tool. A drive pin is connected to the armature and a fulcrum to shiftably move the eraser. In this configuration, the armature reciprocates between the two poles by means for magnetizing the poles.

The present invention incorporates many of the known benefits of detail sanders while improving the mechanism utilized for oscillatingly driving the abrasive pads about a pivot axis.

SUMMARY OF THE INVENTION

A detail sander is provided with a body which has a longitudinal axis, a forward end and a rearward end. The body also defines an internal cavity. A motor is located within the cavity and has a rotatable motor shaft. A crank is provided which is affixed to the motor shaft such that the crank has an offset crank pin projecting therefrom. A lever arm is provided which is pivotally affixed to the body for rotation about a pivot axis generally perpendicular to the motor shaft. The lever arm cooperates with the crank pin to cause the lever arm to cyclically pivot back and forth in response to rotation of the motor shaft. An abrasive pad support has a planar surface and is adapted to receive a planar work member. The pad support is affixed to a free end of the lever arm at a location spaced apart from the pivot axis and oscillates therewith for sanding a surface. The pad support planar surface is symmetrical about a longitudinal center line and has a forward most tip region which has two facet edges which form a substantially 90° corner. A pair of straight side edges are provided which extend rearwardly from the tip region such that each is outwardly inclined from the center line of the pad support 10°–30°.

Further, a sandpaper pad having a corresponding novel shape is provided which is adapted to be removably attached to the pad support by a thin layer of adhesive.

Also provided is a detail sander having a body which defines an internal cavity. A motor is located within the cavity and has a rotatable shaft affixed thereto. A crank is affixed to the motor shaft such that the crank has a crank pin projecting therefrom. A lever arm is provided which is axially aligned with the motor shaft. The lever arm has a first end, a second end and a central portion. The first end cooperates with the crank. The central portion is pivotally affixed to the body enabling the lever arm to cyclically pivot back and forth in response to rotation of the motor shaft. An abrasive pad support is affixed to the second end of the lever arm and oscillates therewith for sanding the surface.

Further, a detail sander is provided which has a body defining an internal cavity. A motor is located within a cavity and has a rotatable motor shaft affixed thereto. A crank is affixed to the motor shaft such that the crank has a crank pin projecting therefrom. A lever arm is provided which is axially aligned with the motor shaft. The lever arm has a first end, a second end, and a central portion. The first end cooperates with the crank. The central portion is pivotally affixed to the body to enable the lever arm to cyclically pivot back and forth in response to rotation of the motor shaft. A leg is provided which is affixed between the second end of the lever arm and an abrasive pad support. The leg locates the pad support below the lever arm and parallel therewith. The leg and the pad support oscillate with the lever arm for sanding the surface. Accordingly, it is an object of the present invention to provide a detail sander wherein the motor shaft and the lever arm are axially aligned and pivot about a pivot pin oriented generally perpendicular thereto.

Further, a novel pad support adapted to receive a planar working member is described. The pad support is generally symmetrical about a longitudinal center line and provided with a forward most tip region having a pair of facet edges which form a substantially 90° corner. A pair of straight side edges extend rearwardly from the tip region and are inclined outwardly 10°–30° from the pad support longitudinal center line.

An additional object of the present invention is to provide a lever arm having a plurality of apertures adapted to selectively receive a pivot pin thereby enabling an oscillating range of pad support to be varied.

An advantage of the present invention is that the configuration of the device enables it to comfortably cooperate with the hand of an operator.

A further advantage of the present invention is that eccentric rotation of the crank pin is converted to pivotal movement of the lever arm.

A further advantage of the pad support of the present invention is that the rearwardly outwardly inclined side edges can be utilized to stand along a seam formed by two intersecting planar surfaces with minimal loading and wear of the tip regions of the work member.

A feature of the present invention is to provide the pad support having a planar surface parallel to and offset from the motor shaft a sufficient distance to provide clearance between the body and a substantially flat surface to be sanded which is in coplanar relation with the pad support.

An additional feature of the present invention is that the 90° tip region pad of the support provides for increased durability and a longer sandpaper life when the detail sander is used to sand a corner formed by two substantially perpendicular walls which abut the work surface.

An additional feature of the present invention is that the pad support is generally parallel to the lever arm and the planar surface of the pad support is generally perpendicular to the pivot pin such that the oscillating of the pad support occurs within a plane defined by the pad support.

A further feature of the present invention is that the pivot axis is spaced apart from the pad support resulting in oscillating movement of the pad support in response to movement of the lever arm.

The above objects, features and advantages of the present invention are readily apparent from the following detailed description of the invention when taken in connection with the accompanying drawings.

BRIEF DESCRIPTION OF THE DRAWINGS

FIG. 14 is a top plan view of the sandpaper pad that cooperates with the pad support shown in FIG. 11;

FIG. 15 is a right side view of the sandpaper pad shown in FIG. 14, the left side view being a mirror image thereof;

FIG. 16 is a front side elevational view of the sandpaper pad shown in FIG. 14;

FIG. 17 is a bottom plan view of the sandpaper pad shown in FIG. 14; and FIG. 18 is a rear side elevational view of the sandpaper pad shown in FIG. 14.

DETAILED DESCRIPTION OF THE INVENTION

Figure 1:
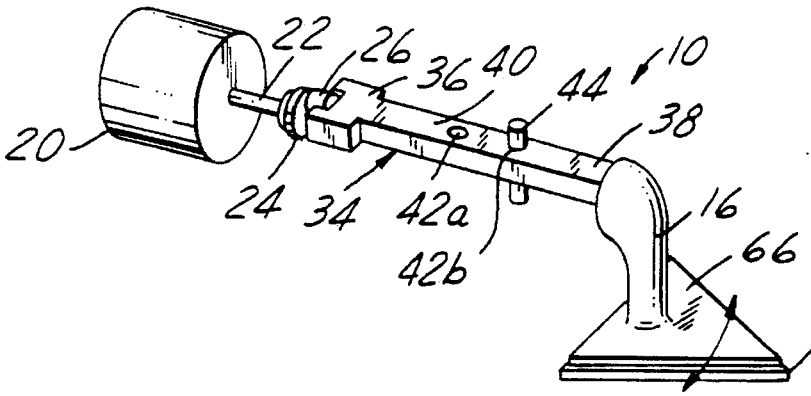
FIG. 1 is a perspective view of a schematic representation showing the major elements in accordance with the present invention.
Figure 5:
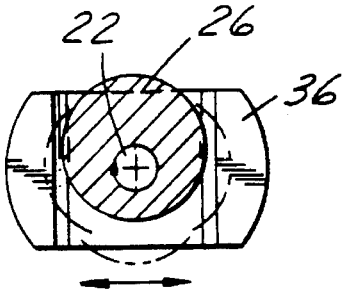
FIG. 5 is an end view taken along line 5—5 of FIG. 4.
Figure 4:
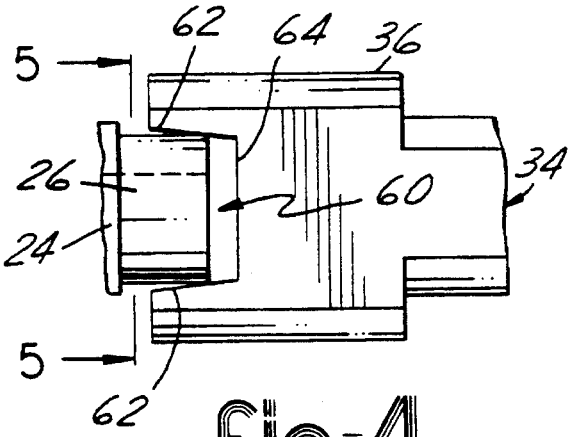
FIG. 4 is a partial plan view of the crank pin cooperating with the first end of the lever arm.

The preferred embodiment shown in FIGS. 1 through 8 illustrates a detail sander 10, which is utilized for sanding inside corners and other hard to reach locations. The detail sander 10 has a body 12, including a grip portion 13 for cooperation with the hand of an operator. The body 12 forms an internal cavity 14. A leg 16 is attached to the body 12 and cooperates therewith. Pad support 18 is attached to the leg 16 for supporting a work member such as sandpaper pad 19. In this embodiment, the member is intended to be sandpaper pad 19 or a similar abrasive material is removably attached to pad support 18 by a thin layer of adhesive.

Figure 2:
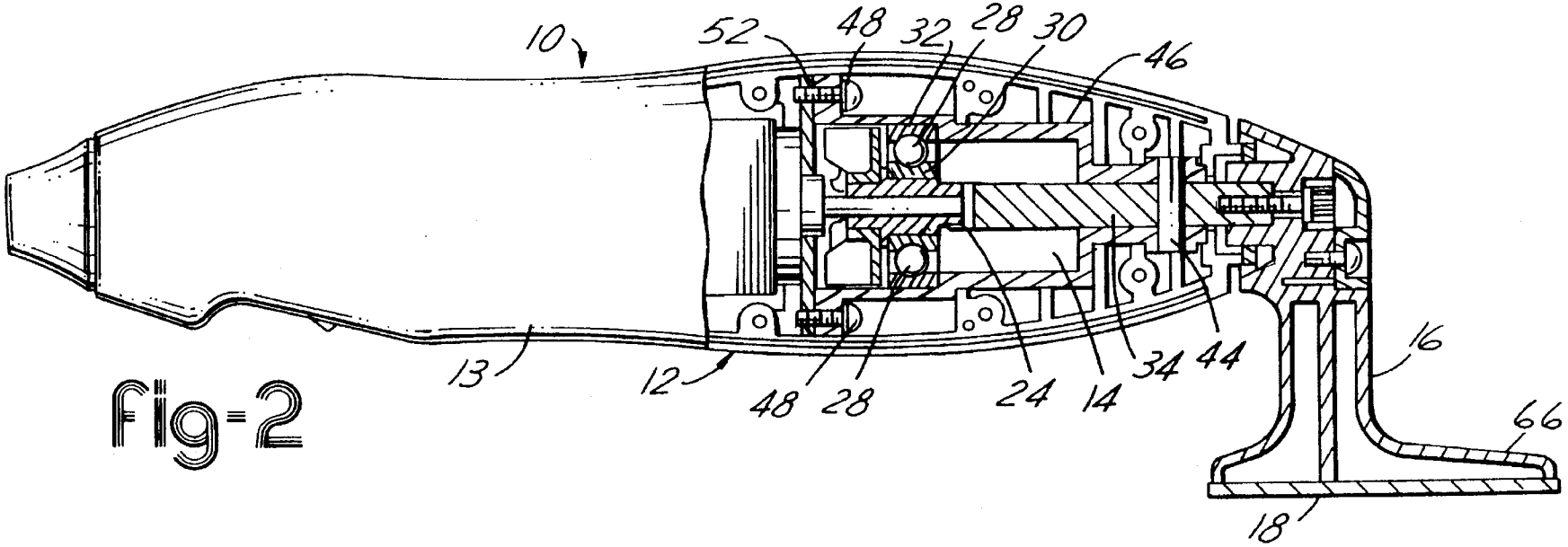
FIG. 2 is a perspective view of the device partially broken away showing the internal elements of the present invention.
Figure 3:
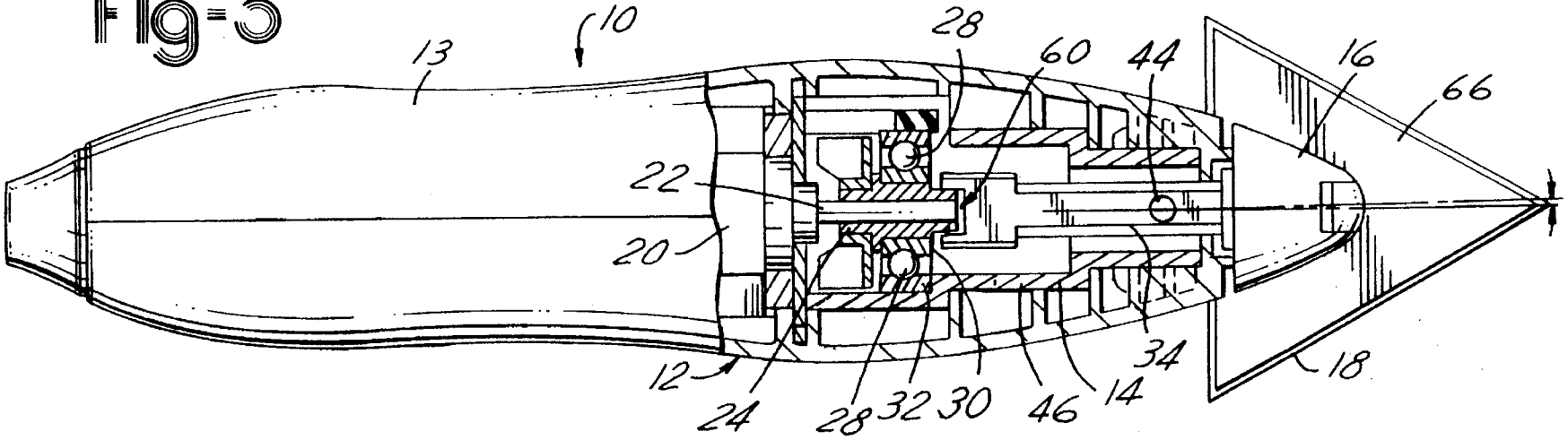
FIG. 3 is a plan view of the device partially broken away showing the internal elements of the present invention.

As shown in FIGS. 2 and 3, the body 12 of the sander 10 has a generally longitudinal orientation such that the grip portion 13 is configured to fit comfortably in the hand of an operator. A motor 20 has a generally similar orientation as the body 12. A motor shaft 22 projects outward from the motor 20 along the longitudinal axis of the motor 20 and is rotatably driven by the motor 20. A crank 24 is affixed to the motor shaft 22 so as to be driven by the motor shaft 22. As shown in FIG. 3, the crank 24 is affixed to the motor shaft 22 such that the motor shaft 22 passes through the crank 24. A crank pin 26 is generally parallel to and radially off set from the motor shaft 22. The crank pin 26 is affixed to the crank 24 and extends outwardly therefrom.

A bearing 28, shown in FIGS. 2 and 3, substantially surrounds the crank 24. The bearing 28 includes an inner race 30 and an outer race 32 and a series of balls or rollers for transmitting radial loads occurring from eccentric rotation and transilatory movement of the crank pin 26 to the body 12. The bearing 28 is affixed to the body 12 to ensure that it is maintained in position and effectively transmits any radial loads received from the crank pin to the body.

Figure 6:
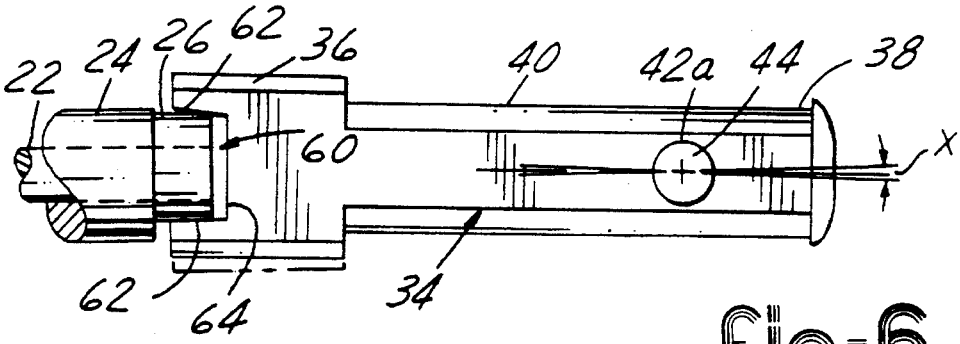
FIG. 6 is a plan view of the crank pin and the lever arm pivoting about a pivot axis located toward the second end of the lever arm.
Figure 7:
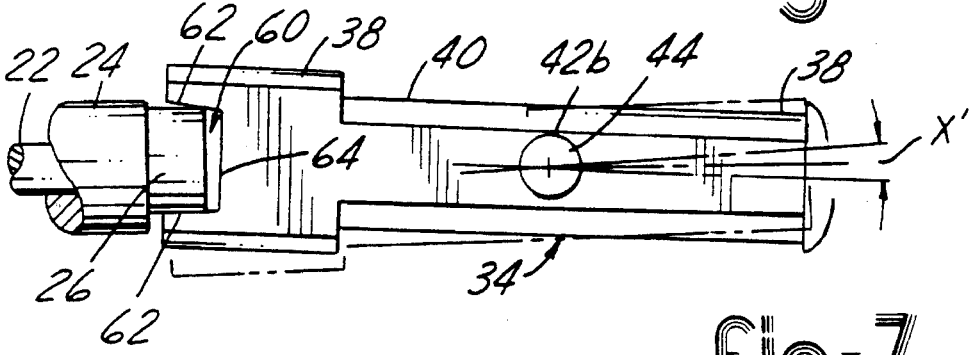
FIG. 7 is a view similar to that shown in FIG. 6 showing the increased oscillating range of the device pivoting about a pivot axis located toward the first end of the lever arm.
Figures 8, 9, 10:
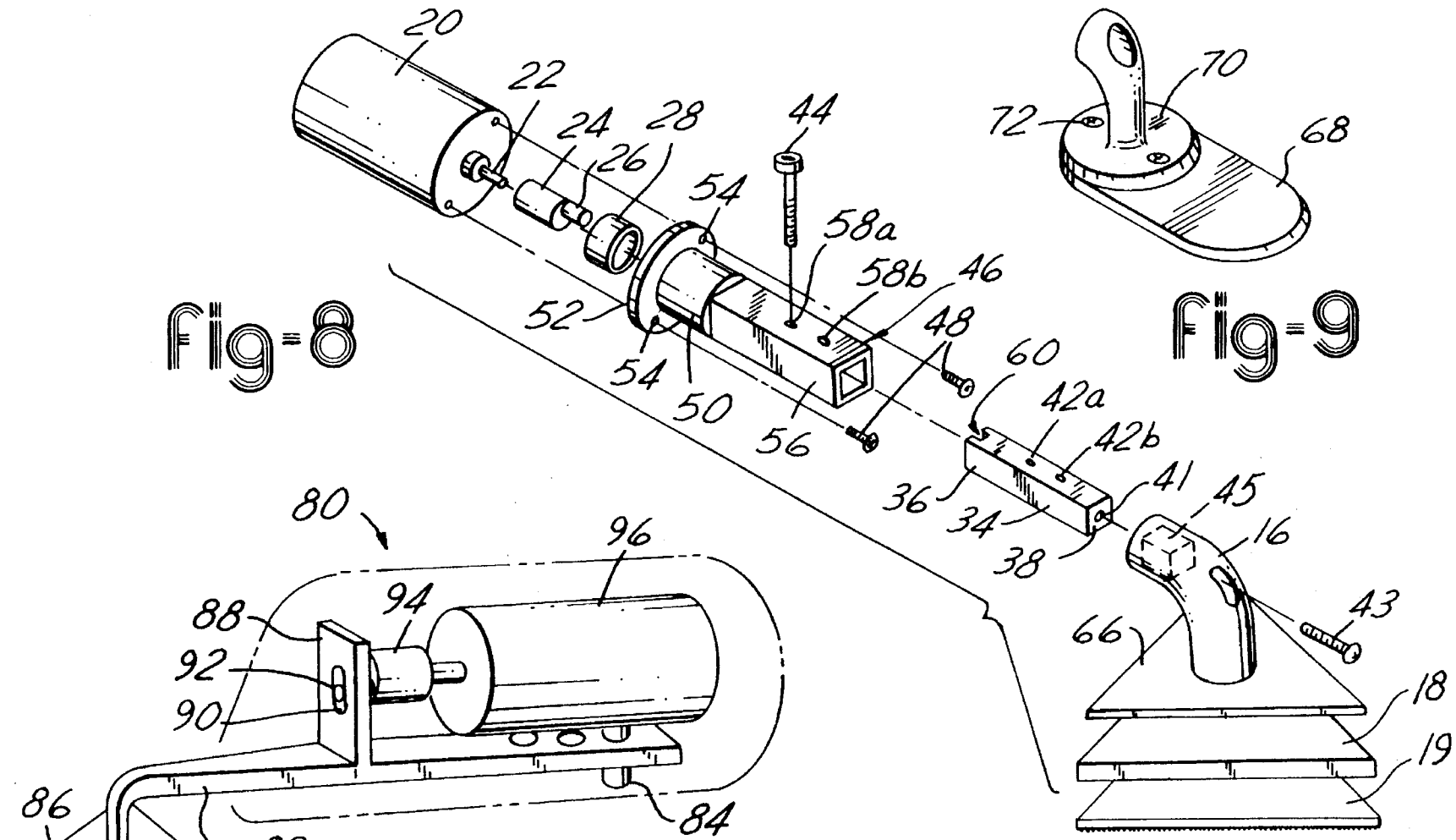
FIG. 8 is an exploded view of the invention.
FIG. 9 is a perspective view of an alternative leg attachment.
FIG. 10 is a perspective view of an alternative embodiment of the present invention.

A lever arm 34 shown in FIGS. 6–8, has a first end 36, a second end 38 and a central region 40. A screw hole 41 is located in the second end 38 to receive a leg screw 43 for securing the leg 16 to the lever arm 34. As shown in FIG. 8, the leg 16 has a rectangular cavity 45 which is adapted to receive the second end 38 of the lever arm 34. The central region 40 of the lever arm 34 defines at least one aperture 42. In the preferred embodiment (shown in FIGS. 1, 5 and 6), the central region 40 defines a pair of apertures **42*a* and 42*b***.

The aperture 42 is adapted to receive a pivot pin 44 about which the lever arm 34 pivots in response to rotation of the motor shaft 22.

As schematically represented in FIG. 1, the motor shaft 22, the crank 24, and the lever arm 34 are generally longitudinally aligned. This alignment serves at least two purposes. First, the profile of the sander 10 is able to be smaller, i.e. have a lower silhouette, which allows the sander 10 to fit more comfortably into the hand of the operator. Secondly, this alignment allows for a very simple mechanical arrangement for oscillating or cyclically pivoting the support pad 18 back and forth.

As shown in FIGS. 2, 3 and 8, a frame 46 surrounds the lever arm 34, the crank 24, the crank pin 26 and the motor shaft 22. The frame 46 supports the pivot pin 44 and is anchored to the motor 20 by conventional means such as screws 48, or the like. The purpose of the frame 46 is to provide internal strength and rigidity to the tool 10 so that the motor shaft 22, the crank 24, the crank pin 26 and the lever arm 34 can effectively work as a unit. This is accomplished by the frame 46 absorbing forces resulting from the interaction of these components, thereby minimizing the load exerted on body 12.

The frame 46 has a first portion 50 which is generally cylindrical in shape. The first portion 50 supports bearing 28 and has a flange 52 located at one end thereof which defines a pair of holes 54 for receiving screws 48. The flange 52 is configured to cooperate with the motor 20 for attachment thereto. A second portion 56 of the frame 46 is generally rectangular in shape. The second portion 56 is adapted to receive the lever arm 34. Pin holes 58*a* and 58*b* correspond to apertures 42*a* and 42*b* in the lever arm 34 to receive the pivot pin 44.

As may be seen in FIG. 1, the location of the pivot (in this embodiment the pivot pin 44) is generally perpendicular to the lever arm 34. The pivot pin 44 is mounted to the body 12 so as to be fixed relative to the lever arm 34. The pivot pin 44 allows the lever arm 34 and the support pad 18 to oscillate in unison, in a parallel plane, about the pivot pin 44.

As shown in FIGS. 4–7, the first end 36 of the lever arm 34 has a slot 60 formed therein. In this embodiment, the slot 60 has a U-shaped configuration. The first end 36 has gradually tapered opposed internal surfaces 62 which are closer together or relatively smaller at a closed end 64 of the slot 60. The first end 36 is adapted to cooperate with the crank pin 26 of the crank 24. As may be seen in FIGS. 5, 6, and 7, the eccentric rotation of the crank 24 causes the crank pin 26 to alternatively contact each one of the internal surfaces 62 during a complete cycle of the crank 24. In a complete cycle, the crank 24 simultaneously undergoes transilatory movement and eccentric rotation within the slot 60 of the lever arm 34. High temperature grease such as sulfurized molybdenum is used at this location and at the pivot pin 44 level arm 34 interface.

During a complete rotational cycle of the crank pin 26, (as shown in FIGS. 6 and 7), the crank pin 26, alternatively contacts each of the internal surfaces 62 of the U-shaped slot 60. This contact causes tangential pressure to be exerted onto the lever arm 34. In response to this tangential pressure, the lever arm 34 pivots about the pivot pin 44 in a direction corresponding to the direction of the pressure being exerted. As the rotational cycle continues, the crank pin 26 will contact both of the internal surfaces 62 which results in the lever arm 34 oscillating back and forth about the pivot pin 44. The cooperation of the first end 36 and the crank pin 26 converts eccentric rotation to pivotal motion of the lever arm 34.

It is this conversion of eccentric rotation of the crank pin 26 to pivotal movement of the lever arm 34 which enables the generally longitudinal alignment of the motor shaft 22, the crank 24, and the lever arm 34 to function so effectively. In the preferred embodiment shown in FIGS. 1, 6 and 7, the lever arm 34 has a pair of apertures 42*a* and 42*b*, respectively. As may be seen in FIGS. 6 and 7, the ability of the lever arm 34 to receive the pivot pin 44 in more than one location allows the range of oscillation (represented in FIGS. 6 and 7 as X and X', respectively) to be varied to accommodate the type of work to be performed. Specifically, FIG. 6 shows the pivot pin 44 seated within aperture 42*a*. Aperture 42*a* is located closer to the second end 38 than is aperture 42*b*. The result is that the range of oscillation X in response to movement of the motor shaft 22 is smaller. By moving the pivot pin 44 to the aperture 42*b*, the range of oscillation X' is relatively increased, as may be seen in FIG. 7.

Figure 12:
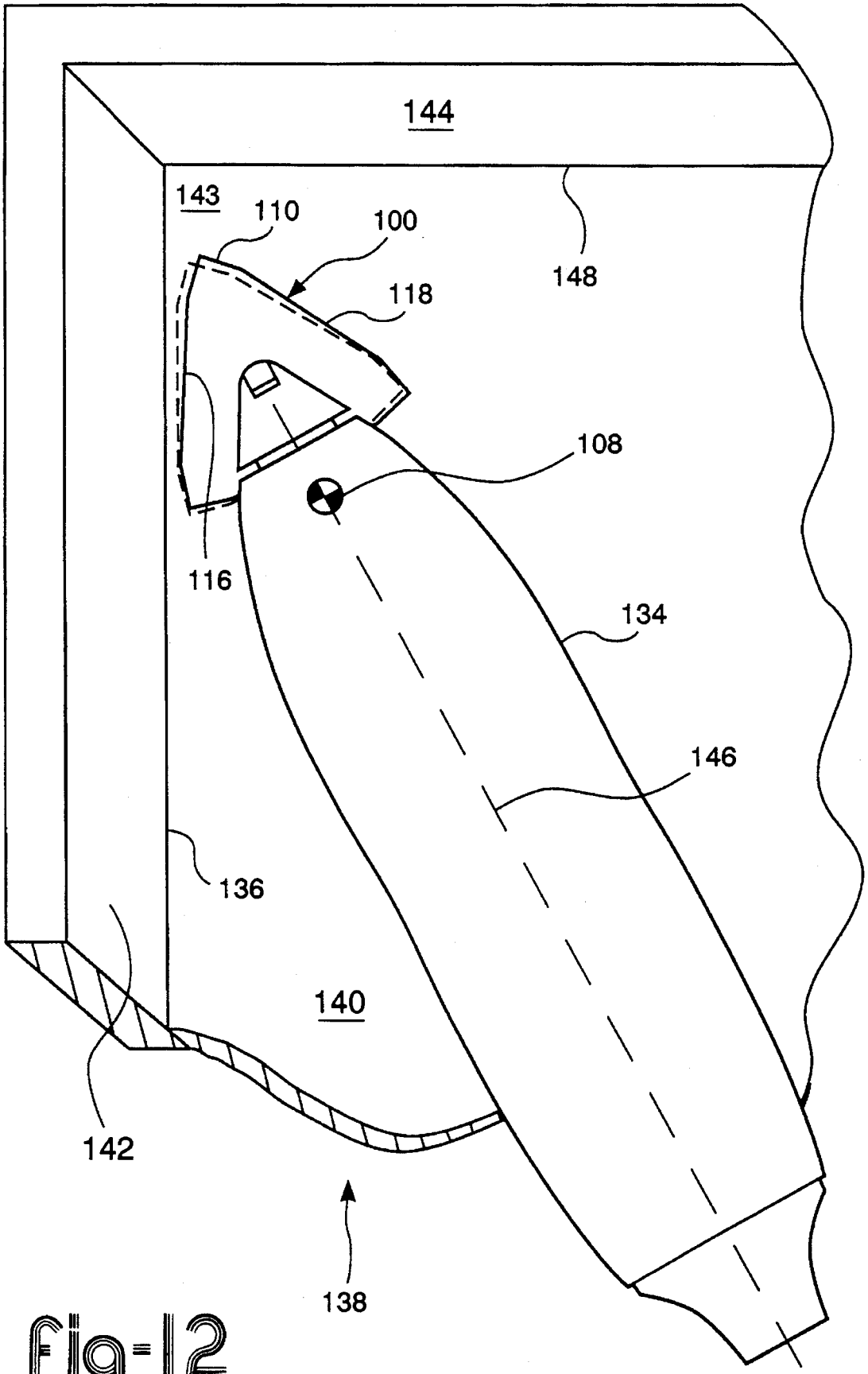
FIG. 12 is a fragmentary view of a drawer being sanded utilizing the device of the present invention.

As shown in FIGS. 2, 8 and 9, the shape of the leg 16 is offset such that it projects outward from the body 12 and generally perpendicular thereto. The result is that the pad support 18 is located a distance from and below the body 12. The pad support 18 is affixed to the leg 16 such that it is parallel with a foot 66. The foot 66 is integrally formed with the leg 16 and is generally parallel with the body 12. The pad support 18 is affixed to the foot 66 so as to be contiguous therewith. The result of the configuration of the leg 16, the foot 66 and the pad support 18 relative to the body 12 is that the planar surface of the pad support 18 is sufficiently spaced from the body 12 so that when sanding a surface which is in coplanar relationship, the hand of the operator comfortably fits about the body 12. In operation, as shown in FIG. 12, the pad support 18 oscillates within a plane defined by the pad support 18.

The pad support 18 shown in FIGS. 1–3, has a generally triangular configuration. However, it is possible that the configuration of the pad support 18 be varied substantially so long as the planar surface is maintained generally parallel to the body 12, while still obtaining the desired features and functions of this invention.

An alternative leg embodiment is shown in FIG. 9. In this embodiment, a scraper blade 68 is affixed to foot 70 by screws 72. The scraper blade 68 can be utilized for removing wallpaper or the like. Foot 70 can be installed on the end of lever arm 34 in place of leg 16.

An alternative embodiment of the invention is illustrated in FIG. 10. Detail sander 80 operates in a similar fashion to sanding tool 10 described in FIGS. 1–8. Rather than the centrally pivoting lever arm 34, lever 82 is pivoted upon pin 84. Pad support assembly 86 is affixed to the opposite end of lever 82. In the central region of lever 82, flange 88 is provided in which is formed an elongated slot 90 for receiving crank pin 92 formed on crank 94. Motor 96 rotates the crank pin 92 in a manner similar to the sanding tool described previously. Lever 82 is preferably provided with a plurality of holes so that the pivot pin 84 can be alternatively positioned at different locations for varying the stroke of the pad.

Figure 11:
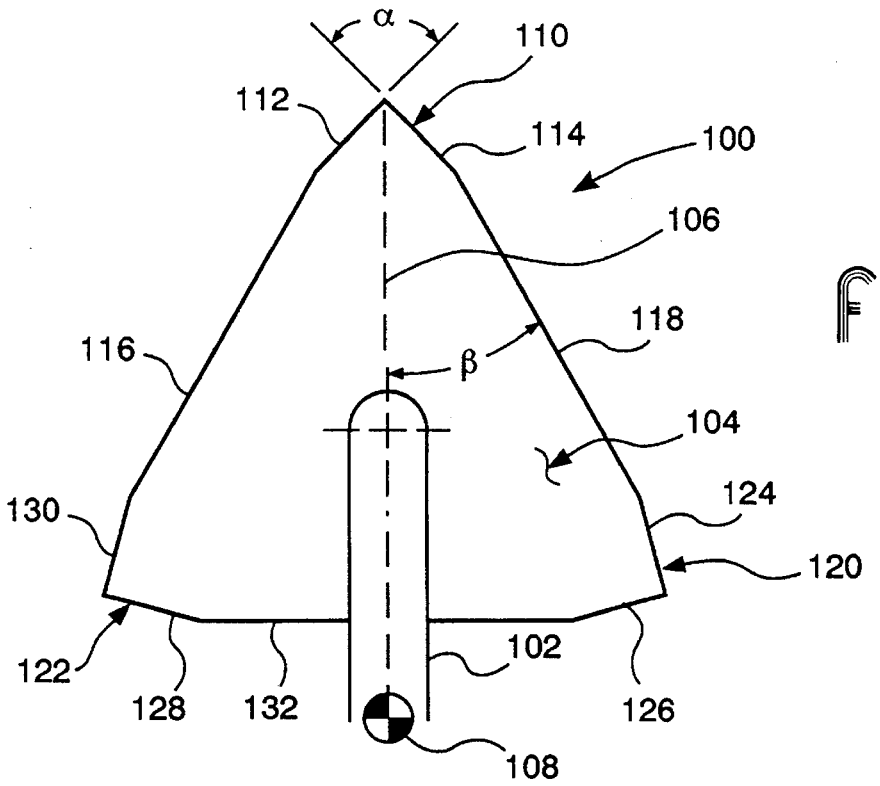
FIG. 11 is a plan view illustrating the peripheral outline of a second pad support embodiment.

An alternative pad support assembly 100 is shown in FIGS. 11 and 12. Pad support assembly 100 is an alternative to the equilateral triangle design as shown previously in FIGS. 1, 3, 8 and 10. The pad support assembly 100 is made up of a rigid plastic leg 102, a rigid plastic foot portion 104 and an elastic planar pad support member (not shown) which is affixed to the underside of foot portion 104 in the same manner pad support 18 is affixed to foot 66 illustrated in FIG. 8. The elastic planar pad support member affixed to the planar underside of foot portion 104, as well as pad support 18 described previously, is preferably made of a thin relatively dense elastic material such as a sheet of 50 durometer (Shore A), styrene/butadiene material approximately 0.100 inches thick.

The outer periphery of pad support assembly 100 forms a nine sided polygon. The pad support is symmetrically aligned along a longitudinal center line 106. Longitudinal center line 106 is generally aligned with the longitudinal axis of the detail sander 134 deviating slightly therefrom as the lever arm (not shown), and the pad support pivot about pivot point 108. The forward most portion of the pad support forms a forward tip region 110 defined by a pair of facet edges 12 and 114 oriented at angle $\alpha$ to one another. Preferably, the angle $\alpha$ is substantially 90°. Most preferably, angle $\alpha$ will fall between 90° and 90° plus the angle of oscillation of the lever pad support assembly about a pivot point 108. In the embodiment illustrated, in FIG. 11, $\alpha$ is a nominal 91° (plus or minus a one degree manufacturing tolerance). The pad support assembly 100 additionally has a pair of straight side edges 116 and 118, each extending rearwardly from facet edges 112 and 114, respectively, outwardly inclined from center line 106 at an angle $\beta$ ranging from 10 to 30 degrees. In the embodiment illustrated, which is preferable in the majority of instances, angle $\beta$ is equal to 30°.

In order to maximize the amount of usage from a single sheet of sandpaper, it is very desirable to have a pad support which has three corners as illustrated in FIG. 11. The right and left corners 120 and 132 are symmetrical with forward tip region 110 and are defined by facet edges 124, 126, 128 and 130 as illustrated. Extending between facet edges 126 and 128 is a rear edge 122 which extends perpendicular to center line 106. This three corner symmetrical design enables the sandpaper having become worn at the forward most tip region 110 to be removed, rotated 120° and reinstalled in order to utilize all three corners of the sandpaper.

It should be appreciated that the forward most tip of the sandpaper wears the quickest. The utilization of a substantially 90° corner as opposed to a 60° corner illustrated in the equilateral triangle design described previously, significantly increases sandpaper life. The reason for this gain in life is two-fold. First, angle $\alpha$ being greater, the corner is less sharp and has more sandpaper area and is less susceptible to damage when sanding with the corner. Secondly, the fact that the tip of the sandpaper is no longer aligned with the side edges minimizes wear in the corner regions, when the sander is being worked along the seam formed by two intersecting planar surfaces (as shown in FIG. 12). When using the sander to sand along a seam formed by two planar surfaces, the user typically rocks the sander slightly to concentrate the sanding load, for example, along the side edge of the pad support. Since the pad support assembly is somewhat elastic, there would typically be very little normal force exerted on the workpiece by corner 120 when side edge 116 is being utilized. This offset corner design results in very little wear occurring in the corners when the side edges 116 and 118 are being used. The corners are inwardly offset from a line defined by the adjacent straight side edges approximately 0.100 inches.

FIG. 12 illustrates the nine sided polygon pad support assembly 100 affixed to a sander 134. The sander is being used to sand a seam 136 formed in a drawer 138 between drawer bottom 140 and drawer side 142. Pad support oscillates side to side about pivot 108 between the extreme right position shown in solid outline and the extreme left position shown in dotted outline. For purposes of illustration, the magnitude of the movement is exaggerated slightly. In the preferred embodiment, the angle of oscillation is only 1 to 2 degrees. Unlike prior art sanders of Kloss, Brown or Zuzelo which rotate about a central pivot point, the present invention has a pivot point 108 which is offset outside of the outer periphery of the pad support in plain view. This causes the pad support to oscillate back and forth, side to side enabling a straight side edge to be effectively used. The straight side edge is particularly important when the user tries to rock the sander slightly in order to concentrate the sanding effort along the region immediately adjacent to the seam 136.

When sanding the corner region 143 of the drawer, it is necessary for the tip of pad support assembly 100 to get completely into the corner which is formed by the intersection of the drawer bottom 140, side wall 142 and rear wall 144 oriented 90° to one another. The forward most tip region 110 of the pad support is used when sanding corner region 143. The longitudinal axis 146 of the sander will be oriented 45° from side wall 142 and back wall 144 to facilitate the insertion of sanding pad forward tip region 110 completely into corner 143. As described previously, the sander will be rocked slightly in order to concentrate the load exerted by the sandpaper or other abrasive material affixed to the pad support in the region to be sanded. When sanding seam 148 formed at the junction of drawer bottom 140 and back panel 144, the side edge 118 of the pad support will be utilized in a manner described previously.

Figure 13:
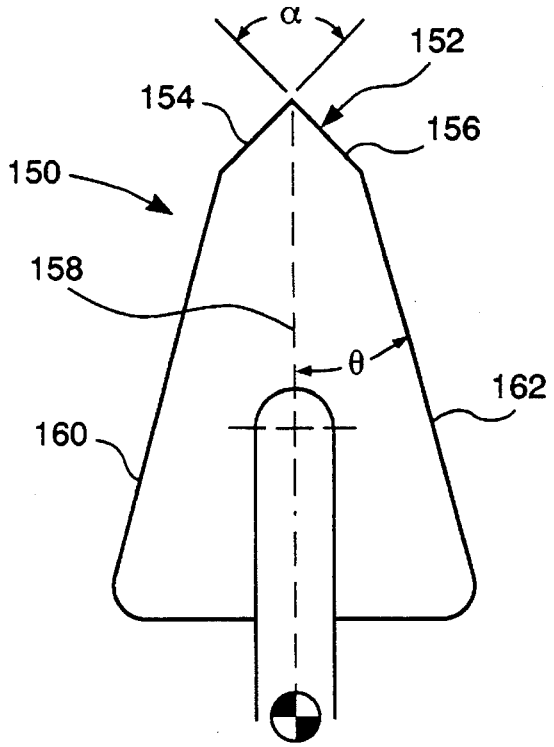
FIG. 13 is a peripheral outline illustrating a third pad support embodiment.

A third pad support assembly embodiment 150 is illustrated in FIG. 13. Pad support 150, unlike the equilateral triangle embodiment and the nine sided polygon embodiment described previously, does not have a plurality of corners which facilitate the removal and rotation of the sandpaper to a different position. Like pad support assembly 100, the third pad support embodiment 150 is provided with a corner 152 formed by a pair of facet edges 154 and 156 defining an angle $\alpha$. Preferably angle $\alpha$ is approximately 90° or slightly larger. Pad support assembly 150 is symmetrical about center line 158 and is provided with a pair of straight side edges 160 and 162 which extend rearwardly, outwardly at an angle $\theta$ relative to center line 158. In the embodiment illustrated, $\theta$ is approximately at 10° which results in the pad support 150 having a narrow width. Pad support 150 is therefore useful in situations where it is necessary to reach into tight places such as between spindles forming the back of a Windsor chair. Corner 152 is inwardly offset significantly from the line defining side edges 160 and 162. One, therefore, can utilize these side edges with minimal wear of the forward most corner portion of the abrasive pad being used.

A second sandpaper pad embodiment 19' is shown in FIGS. 14–18. This embodiment is designed to be removably attached to the alternative pad support assembly 100, shown in FIGS. 11 and 12. The sandpaper pad 19' is formed of a thin planar member having an abrasive side 164 and an opposite side 166. Opposite side 166 is preferably coated with a thin layer of adhesive 168 to facilitate the attachment of the sandpaper pad 19' to a detail sander pad support. The peripheral shape of sandpaper pad 19' as shown in FIG. 17 corresponds to pad support assembly 100 shown in FIG. 11, and like elements are given a prime number designation.

While the best mode for carrying out the invention has been described in detail, those familiar to the art to which this invention relates will recognize various alternative designs and embodiments for practicing the invention as defined by the following claims.

What is claimed:

1. An abrasive pad support for attachment to a detail sander, said abrasive pad support comprising:

a member having a planar surface generally symmetrical about a longitudinal center line and having an outer peripheral edge forming a forward most tip region having two facet edges creating a substantially 90° corner and a pair of straight side edges extending rearwardly from the tip region, each straight side edge being outwardly inclined from the pad support center line 10–30 degrees.

2. The abrasive pad support of claim 1 wherein each straight side edge is oriented 30° from the pad center line.

3. The abrasive pad support of claim 1 wherein said member is provided with a rearward edge extending perpendicular to the center line and a right rear and left rear tip region each formed by a pair of facet edges oriented substantially 90° to one another, wherein said edges form a nine sided polygon which is symmetrical about a line which extends through the member center and any one of the three substantially 90° corners formed by the tip region.

4. An abrasive pad for a sanding tool comprising:

an abrasive pad support member; and a replaceable sandpaper pad bonded to the support member by a thin layer of adhesive;

wherein said support member and said sandpaper pad having a corresponding outer peripheral shape which is generally symmetrical about a longitudinal center line and having a forward most tip region having two facet edges creating a substantially 90° corner and a pair of straight side edges extending rearwardly from the tip region, each side edge being outwardly inclined from the center line 30 degrees, a rearward edge extending perpendicular to the center line, and right rear and left rear tip regions each formed by a pair of facet edges, each facet edge oriented substantially 90° to each other, wherein said edges form a nine sided polygon which is symmetrical about a line which extends through the support member center and any one of the three substantially 90° corners formed by the tip region.

5. A sandpaper pad for attachment to a pad support of a detail sander, said sandpaper pad comprising:

a thin planar member having an abrasive side for sanding a work piece and an opposite side for attachment to said pad support, said thin planar member being generally symmetrical about a longitudinal center line and having an outer peripheral edge forming a forward most tip region having two facet edges creating a substantially 90° corner and a pair of straight side edges extending rearwardly from the tip region, each side edge being outwardly inclined from the center line 10–30 degrees.

6. The sandpaper pad of claim 5 wherein each straight side edge is oriented 30° from the pad center line.

7. The sandpaper pad of claim 5 wherein said thin planar member is provided with a rearward edge extending perpendicular to the center line and right rear and left rear tip regions each formed by a pair of facet edges, each facet edge oriented substantially 90° to each other, wherein said edges form a nine sided polygon which is symmetrical about a line which extends through the thin planar member center and any one of the three substantially 90° corners formed by the tip region.

8. The sandpaper pad of claim 5 further comprising a thin layer of adhesive applied upon the thin planar member opposite side for bonding the sandpaper pad to said pad support.

9. A sandpaper pad for attachment to a pad support of a detail sander, said sandpaper pad comprising:

a thin planar member having an abrasive side for sanding a work piece and an opposite side for attachment to said pad support, said thin planar member being generally symmetrical about a longitudinal center line and having an outer peripheral edge forming a forward most tip region having two facet edges creating a substantially 90° corner and a pair of straight side edges extending rearwardly from the tip region, each side edge being outwardly inclined from the center line 30 degrees, a rearward edge extending perpendicular to the center line, and right rear and left rear tip regions each formed by a pair of facet edges, each facet edge oriented substantially 90° to each other, wherein said edges form a nine sided polygon which is symmetrical about a line which extends through the thin planar member center and any one of the three substantially 90° corners formed by the tip region; and a thin layer of adhesive applied upon the thin planar member opposite side for bonding the sandpaper pad to said pad support.

10. An abrasive pad for attachment to a pad support of a detail sander for working on a workpiece, said abrasive pad comprising:

a planar member having an abrasive side for abrading the workpiece and an opposite side for removable attachment to said pad support, said planar member being generally symmetrical about a longitudinal center line and having an outer peripheral edge forming a forward-most tip region having two facet edges creating a substantially 90° corner and a pair of straight side edges extending rearwardly from the tip region, each straight side edge being outwardly inclined from the center line 10°–30°.

* * * * *

Disclaimer 5,533,926—John E. Nemazi, Bloomfield Hills, Mich. SANDPAPAER PAD AND PAD SUPPORT FOR A DETAIL SANDER. Patent dated July 9, 1996. Disclaimer filed September 18, 1997, by the assignee, Ryobi North America, Inc.

The term of this patent shall not extend beyond the expiration date of Pat. No. D. 355,105.
*(Official Gazette,* December 9, 1997)